US009035737B2

(12) United States Patent
Nanayakkara et al.

(10) Patent No.: US 9,035,737 B2
(45) Date of Patent: May 19, 2015

(54) HIGH SPEED TRANSFORMER

(75) Inventors: Ravi Nanayakkara, Racine, WI (US); Jeffrey R. Annis, Waukesha, WI (US); Douglas J. Bader, Grafton, WI (US); Randall S. Langer, Oak Creek, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 442 days.

(21) Appl. No.: 12/894,410

(22) Filed: Sep. 30, 2010

(65) Prior Publication Data

US 2012/0081202 A1 Apr. 5, 2012

(51) Int. Cl.

| | |
|---|---|
| ***H01F 5/00*** | (2006.01) |
| ***H01F 27/28*** | (2006.01) |
| ***H01F 19/04*** | (2006.01) |

(52) U.S. Cl.

CPC ..... *H01F 19/04* (2013.01); *H01F 2027/2809* (2013.01)

(58) Field of Classification Search

USPC ..... 336/200, 232

See application file for complete search history.

(56) References Cited

U.S. PATENT DOCUMENTS

| | | | | |
|---|---|---|---|---|
| 3,535,610 | A * | 10/1970 | Maynard | 363/129 |
| 4,012,703 | A * | 3/1977 | Chamberlayne | 333/24 R |
| 5,225,971 | A * | 7/1993 | Spreen | 363/17 |
| 5,331,536 | A * | 7/1994 | Lane | 363/126 |
| 5,521,573 | A * | 5/1996 | Inoh et al. | 336/180 |
| 5,801,602 | A * | 9/1998 | Fawal et al. | 333/177 |
| 5,949,321 | A * | 9/1999 | Grandmont et al. | 336/232 |
| 6,000,128 | A * | 12/1999 | Umeno et al. | 29/846 |
| 6,005,355 | A * | 12/1999 | Siao | 315/277 |
| 6,972,656 | B2 * | 12/2005 | Takeshima et al. | 336/180 |
| 2002/0070836 | A1 * | 6/2002 | Fujiyoshi et al. | 336/200 |
| 2004/0070481 | A1 * | 4/2004 | Patel et al. | 336/200 |
| 2005/0212640 | A1 * | 9/2005 | Chiang et al. | 336/200 |
| 2007/0057755 | A1 * | 3/2007 | Suzuki et al. | 336/200 |

FOREIGN PATENT DOCUMENTS

WO WO 2009131059 A1 * 10/2009

* cited by examiner

*Primary Examiner* — Tsz Chan

(74) *Attorney, Agent, or Firm* — Fletcher Yoder, P.C.

(57) ABSTRACT

Embodiments of the present invention provide novel techniques for creating a high speed transformer such as a pulse transformer. In particular, a secondary coil of the high speed transformer may include a single turn. The use of a single turn secondary coil simplifies the design and manufacture of the transformer and aids in more efficient inspections. Further, the single turn secondary coil transformer may reduce the number of vias used to interconnect the components of the transformer. Additionally, the embodiments described herein may significantly improve voltage isolation by single turn coils, and eliminate vias between board layers.

16 Claims, 6 Drawing Sheets

HIGH SPEED TRANSFORMER

BACKGROUND

The present invention relates generally to the field of electrical transformers such as those used to control the transfer electrical energy from one circuit to another as well as provide voltage isolation between the control and power circuits. More particularly, the present invention relates to transformers that may be made on or in control electrical circuit boards, and to methods for making such transformers.

High speed transformers are used in a wide range of applications. For example, in power converters capable of converting electrical energy for use with centrifuges, magnetic clutches, pumps and more generally, in electric motor drive controllers that transform and condition incoming AC power for supply to motor drive circuitry. In certain motor drive circuits, silicon controlled rectifiers (SCRs) or other solid state switches are utilized to redirect and rectify incoming AC power and to deliver variable voltage and frequency three-phase power to control the speed of an induction motor. Accordingly, pulse transformers may be employed to provide voltage isolation and drive, i.e., switch solid state switches, according to different phases of the incoming AC power. However, pulse transformers may not provide adequate voltage isolation.

BRIEF DESCRIPTION

Embodiments of the present disclosure provide novel techniques for using a high speed transformer, such as a pulse transformer, to provide for high speed switching, electrical isolation, and/or generation of a gate signal pulses. The high speed transformer embodiments described herein are simple to manufacture, are more reliable to use, are manufactured of less expensive components, and are capable of high speed switching of signals. In particular, certain embodiments of the transformer embodiments described herein can incorporate a single trace winding (e.g., single turn secondary coil and/or single turn primary coil) capable of allowing high frequency switching speeds and a SCR drive current. Indeed, the transformer embodiments described herein are capable of reducing circuit board real estate and reducing the number of vertical interconnect accesses (vias) interconnecting the primary and secondary windings of a pulse transformer.

In a first embodiment, a transformer system is provided which includes a primary coil, a core, and a single-turn secondary coil. The single-turn secondary coil is formed on a layer of a circuit board. A first current flow through the primary coil creates a magnetic flux in the core. The magnetic flux induces a second current flow in the single-turn secondary coil.

In a second embodiment, a transformer system is provided which includes a primary coil formed on at least one layer of a printed circuit board, a core, and a single-turn secondary coil. The single-turn secondary coil is formed on a layer of the printed circuit board. A first current flow through the primary coil creates a magnetic flux in the core. The magnetic flux induces a second current flow in the single-turn secondary coil.

In a third embodiment, a transformer system is provided which includes a primary coil circuit configured to provide an input current, a transformer, and a secondary coil circuit. The transformer includes a primary coil coupled to the primary coil circuit to receive the input current, a core, and a single-turn secondary coil formed on a layer of a printed circuit board. The secondary coil circuit is configured to receive output current from the single-turn secondary coil for provision of current to a load

DRAWINGS

These and other features, aspects, and advantages of the present invention will become better understood when the following detailed description is read with reference to the accompanying drawings in which like characters represent like parts throughout the drawings, wherein.

Figure 7:
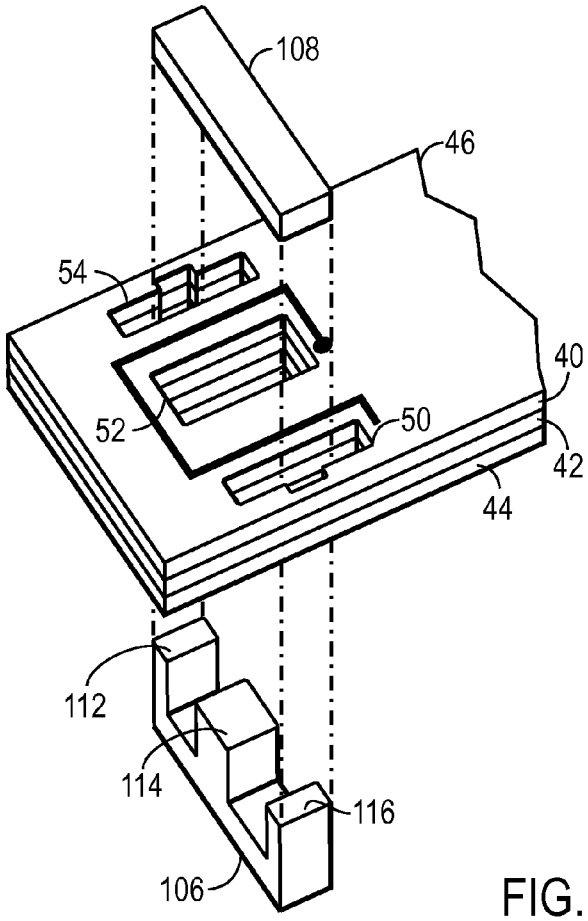
Figure 8:
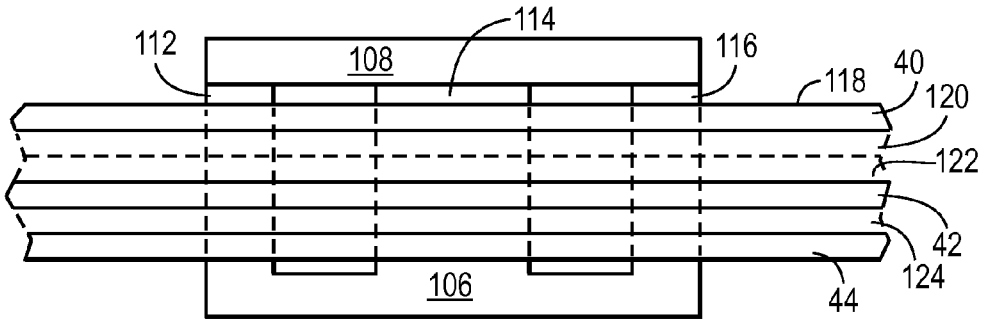
Figure 9:
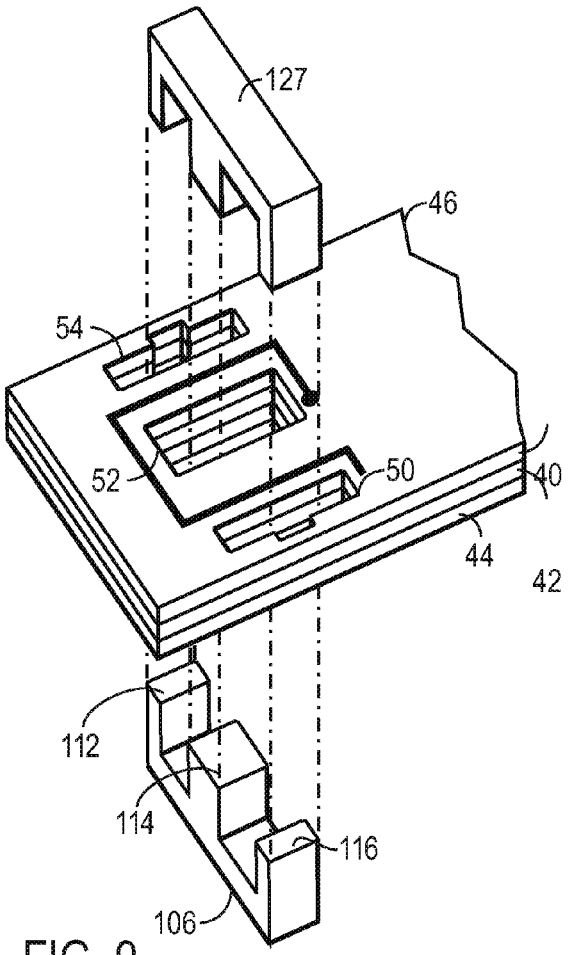
Figure 10:
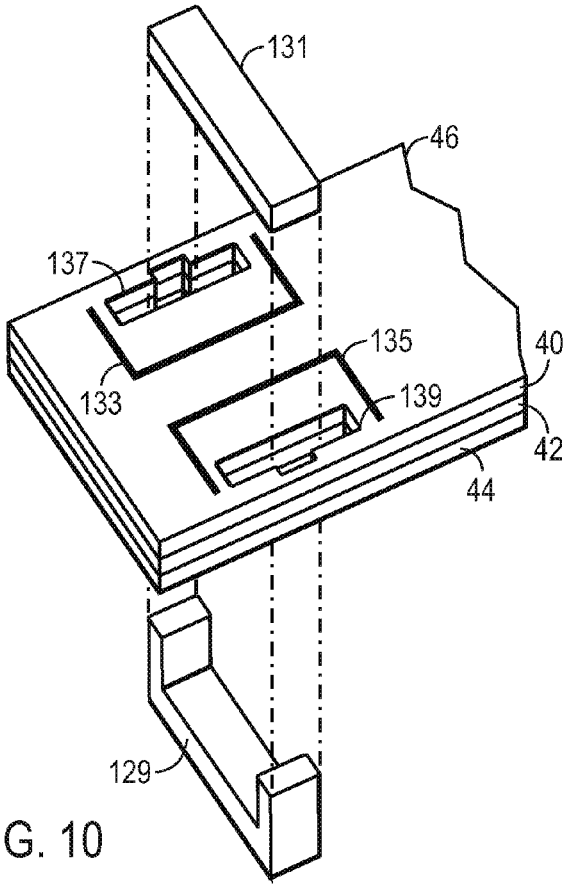
Figure 11:
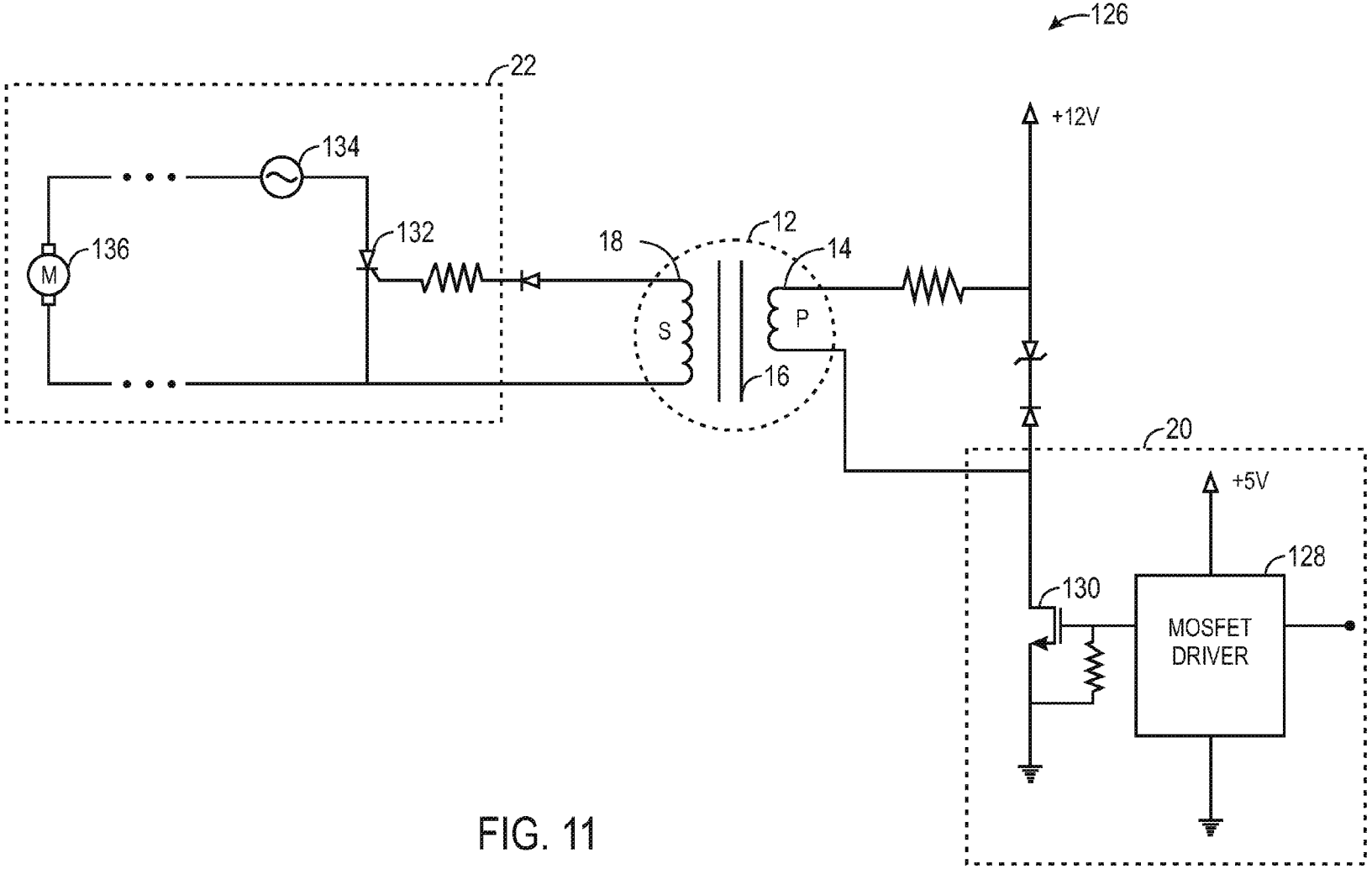

FIG. 7. is an exploded view of embodiments of a printed circuit board and a transformer core;

FIG. 8 is a side view of embodiments of a printed circuit board and a transformer core;

FIG. 9 is an exploded view of embodiments of a printed circuit board and a transformer core;

FIG. 10 is an exploded view of embodiments of a printed circuit board and a transformer core; and FIG. 11 is a schematic view of a motor controller circuit.

DETAILED DESCRIPTION

Figure 1:
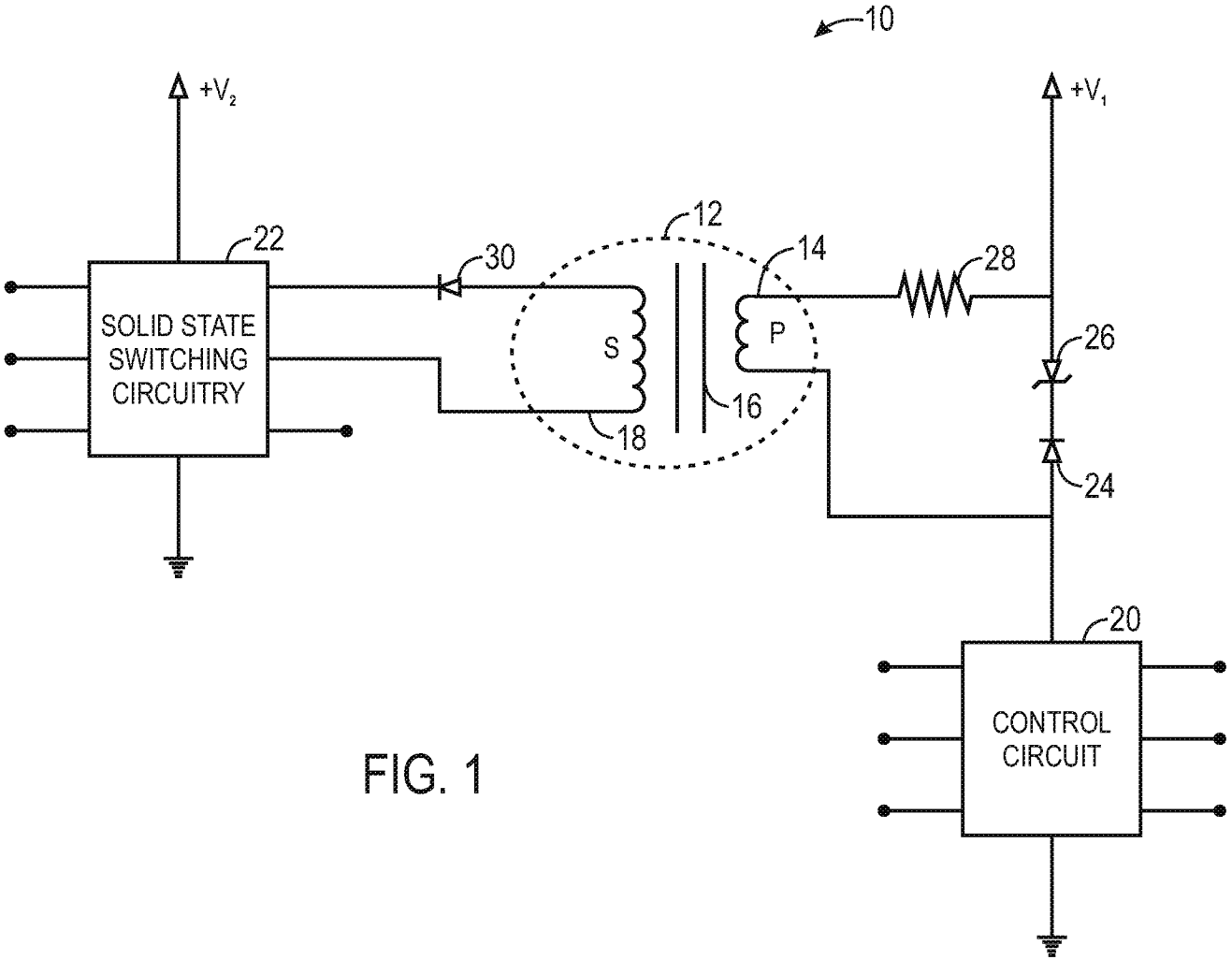
FIG. 1 is a schematic diagram of an embodiment of a high speed transformer.

It may be beneficial to first discuss embodiments of certain transformer systems that may incorporate the techniques described herein. With this in mind and turning now to FIG. 1, the figure is a schematic diagram of an embodiment of an electric circuit 10 including a transformer 12. The electrical circuit 10 of FIG. 1 may be incorporated into electric motor control embodiments, power converter embodiments, photographic flash embodiments, light dimmer embodiments, and so forth. Indeed, the circuit 10 may be used in any number of electrical examples. In certain embodiments, the transformer 12 may be a pulse transformer 12 suitable for high duty cycles (e.g., in excess of 50%) and frequencies in excess of 2 MHz. The transformer 12 includes a primary coil 14, a core 16, and a secondary coil 18. A primary side circuit (e.g., control circuit) 20 enables flow of current into the primary coil 14 of the transformer, which in turn produces a magnetic field. The core 16 may increase the magnetic field strength (i.e., increase a magnetic flux), and also aid in confining and guiding the magnetic field. The magnetic field induces a current flow in the secondary coil 18 of the transformer 12. Accordingly, electrical energy is transferred from the control circuit 20 to a secondary side circuit (e.g., solid state switching circuitry) 22.

In certain embodiments, the primary coil 14 of the transformer 12 may have more turns than the secondary coil 18. Such embodiments of the transformer 12 may "step down" or reduce the voltage resulting in the secondary coil when compared to the voltage in the primary coil 14. Such voltage reduction capabilities may enable the use of a higher voltage to drive devices requiring a lower voltage. In other embodiments, the primary coil 14 of the transformer 12 may have fewer turns than the secondary coil 18. In these embodiments, the transformer 12 may "step up" or increase the voltage resulting in the secondary coil when compared to the voltage in the primary coil 14. Such a voltage increase capability may enable the use of a lower voltage to drive devices requiring a higher voltage. In yet other embodiments, the number of turns of the primary coil 14 and the secondary coil 18 may be approximately equal. In these embodiments, the voltage of the secondary coil 18 may be approximately equal to the voltage of the primary coil 18. Such embodiments may be useful in providing electrical isolation between the control circuit 20 and the solid state switching circuit 22. Indeed, the "step down" and "step up" embodiments may also be capable of enabling electrical isolation between the control circuit 20 and the solid state switching circuit 22, thus protecting any electrically sensitive equipment that may be connected to the transformer 12.

The pulse transformer 12 enables high speed switching (i.e., modulation) of certain devices, such as electric motors. In these embodiments, the pulse transformer 12 and circuitry 20 may be optimized so as transmit electrical pulses, such as rectangular pulses, having fast rise and a fall times and relatively constant amplitudes. That is, the pulse transformer may be suitable for adequately reproducing pulsed signals such as square pulse signals, being generated by the control circuit 20. Indeed, in certain embodiments, the pulse transformer 12 and circuitry 20, 22 may be capable of operating at frequencies of approximately 2 MHz and upwards, while also enabling a driving current suitable for switching a variety of solid state devices (e.g., SCRs, NPN transistors, insulated-gate bipolar transistors, thyristors) and a load voltage of approximately 690 volts and upwards. Accordingly, certain embodiments of the pulse transformer 12 may use, for example, a diode 24 as a current rectifier, a Zener diode 26 as a voltage peak limiter (e.g., regulator), a resistor 28 as a current limiter, and a second diode 30 as a current rectifier. It is to be understood that other electrical and electronic components may also be used, instead of or in addition to the components 24, 26, 28, and 30, such as the components of the control circuit 20 and the solid state switching circuit 22.

Historically, the pulse transformer 12 has included multiple turns in each primary and secondary coils 14 and 18, sometimes in excess of twenty or more turns. The techniques disclosed herein enable a transformer, such as the pulse transformer 12, to include a secondary coil having a single turn. Such a transformer 12 may enable the elimination of multiple vias that are typically used to connect the multiple turns on a circuit board, thus increasing the ease of circuit board construction and lowering manufacturing cost. Further, the size of the transformer 12 may be reduced, gaining valuable circuit board real estate. Additionally, the transformer 12 having a single-turn secondary coil may increase the reliability of the electric circuit 10 and reduce failures due to, for example, over over-voltage breakdown. Further, the transformer 12 may be printed or formed (e.g., by etching) at multiple levels of a circuit board, as described in more detail below. The ability to select multiple board levels for the formation of the transformer 12 may reduce or eliminate the need for potting compounds and/or bismaleimide-triazine (BT) board materials that are typically used to prevent electrical creepage (i.e., unwanted current leaks) and meet clearance distances (i.e. distance between conductive parts) at higher working voltages (e.g., approximately 120 volts or higher).

Figure 2:
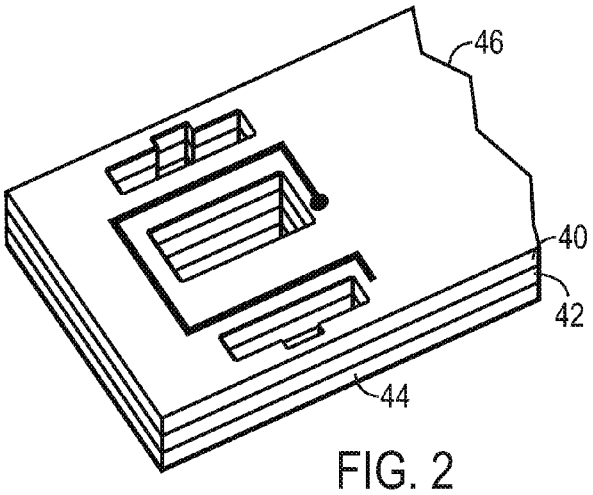
FIG. 2 is a perspective view of an embodiment of a multi-layer printed circuit board.

FIG. 2 is a perspective view depicting multiple layers 40, 42, and 44 that may be used to construct a circuit board, such as a printed circuit board (PCB) 46. In the depicted embodiment, the PCB 46 may be assembled by bonding each of the layers 40, 42, and 44 on top of each other. That is, the layers 40, 42, and 44 may first be printed or plated, for example, with a copper trace and then stacked on top of each another. The stacked layers 40, 42, and 44 may then be heated, pressed and/or cured, thus forming the multi-layer PCB 46. It is to be understood that, in other embodiments, the PCB 46 may include more or less layers.

Figure 3:
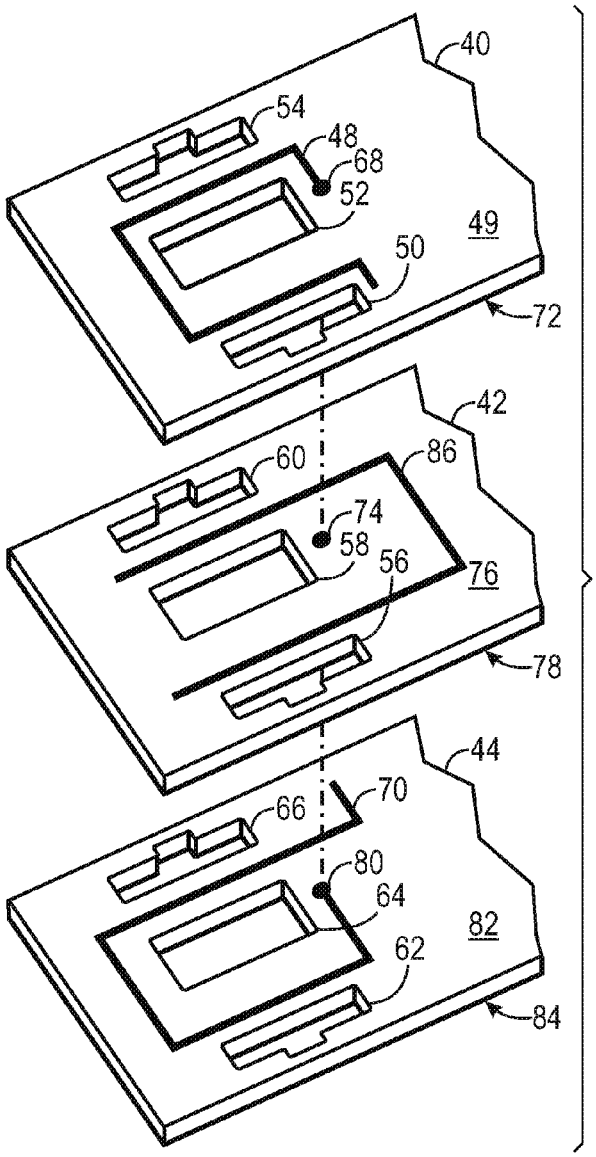
FIG. 3 is an exploded view of the printed circuit board of FIG. 2.

FIG. 3 is an exploded view depicting the layers that 40, 42, and 44 that make up the embodiment of the PCB 46 of FIG. 2. The first layer 40 includes a trace 48 placed on a top surface 49 of the layer 40. The trace 48 may be used as one turn of the primary coil 14. The trace 48 may be a copper trace 48, but any suitable conductive trace may be used. Three openings or holes 50, 52, and 54 are disposed on the layer 40, which enable the core 16 to be placed on the PCB 46 as described in more detail below with respect to FIG. 3. Indeed, approximately identical openings or holes 56, 58, 60, 62, 64, and 66 are placed on the middle layer 42 and on the bottom layer 44, respectively. The openings or holes 50, 52, 54, 56, 58, 60, 62, 64, and 66 are through-holes, that is, they traverse the entirety of the layers 40, 42, and 44.

In one embodiment, a via 68 may disposed on the top layer 40 that allows one end of the trace 48 to connect to a second trace 70 disposed on the bottom layer 44, thus forming the two-turn primary coil 14. The via 68 traverses the entirety of the layer 40. That is, the via 68 extends from the top surface 49 through the interior of the layer 40 to a bottom surface 72 of the layer 40. Likewise, an electrically conductive via 74 is disposed on the middle layer 42, which traverses the layer 42 from a top surface 76 to a bottom surface 78. In the depicted embodiment, an electrically conductive via 80 is disposed on the third layer 44 so as to traverse the third layer 44 from a top surface 82 to a bottom surface 84. Accordingly, electrical conductivity is established between the top trace 48 and the bottom trace 70 through the electrically conductive vias 68, 74, and 80. Indeed, the depicted layers 40, 42, and 44 may be used to print the primary and secondary coils of the transformer 12 using only a single via at each of layers 40, 42, and 44. Having a single via at each layer 40, 42, and 44 increases the reliability of the transformer 12 because such a transformer is simpler to manufacture and inspect. Additionally, the features described herein improve voltage isolation between the primary and secondary coils of the transformer 12.

The secondary coil 18 of the transformer 12 includes a single-turn trace 86. The single-turn trace 86 does not require any vias because there is no need to connect with any other layer. Indeed, the secondary coil 18 can be printed as a single trace on a surface of the layer 42, such as the top surface 76. In another embodiment, such as a single turn primary coil embodiment, the single trace 86 may be printed on the bottom surface 78 of the layer 42. In this embodiment, the clearance distance between the traces 48 and 86 is increased because of the additional separation between the two traces 48 and 86. The increased clearance distance may improve reliability of the transformer 12 and aid in preventing over-voltage breakdown. In yet another embodiment, the trace 86 may be printed on the bottom surface 72 of the layer 40. In this embodiment, the PCB 46 may then consist of the layer 40 disposed on top of the layer 44. Having a PCB 46 with two layers may additionally improve the ease of manufacture and inspection of the PCB 46 while also reducing cost. Likewise, the trace 86 may be printed on the bottom surface 84 of the layer 44. Printing the trace 86 on the bottom surface 84 allows for an easier interconnection with electronic components such as diodes, resistors, capacitors, and so forth, that may be placed on the bottom surface 84.

The layers of the PCB 46, including layers 40, 42, and 44, may include a number of substrates, including dielectric substrates. Some example substrates include polytetrafluoroethylene (e.g., Teflon®), fire retardant (FR) substrates, composite epoxy material (CEM) substrates, glass (G) substrates, and national electrical manufacturers association (NEMA) substrates (e.g., XPC, X, XX, and XXX). Such substrates may include FR-1 (e.g., phenolic paper), FR-2 (e.g., phenolic cotton paper), FR-3 (e.g., cotton paper and epoxy), FR-4 (e.g., woven glass and epoxy), FR-5 (e.g., woven glass and epoxy), FR-6 (e.g., matte glass and polyester), CEM-1 (e.g., cotton paper and epoxy), CEM-2 (e.g., cotton paper and epoxy), CEM-3 (e.g., woven glass and epoxy), CEM-4 (e.g., woven glass and epoxy), CEM-5 (e.g., woven glass and polyester), and G-10 (e.g., woven glass and epoxy). Because of the ease of forming the primary coil 14 (e.g., traces 48 and 70) and the secondary coil 18 (e.g., trace 86), the PCB 46 may be assembled with any number of substrates, including the substrates listed above. Such flexibility of manufacture allows the transformer 12 to be formed on a variety of board materials and assembled more quickly, efficiently, and inexpensively.

Figure 4:
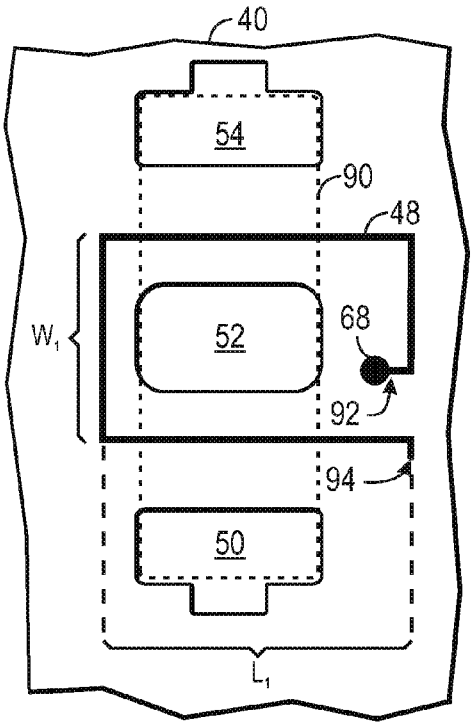
FIG. 4 is top view of an embodiment of a layer of a first layer printed circuit board.

FIG. 4 is a top view of embodiments of the trace 48 and through holes 50, 52, and 54 of the layer 40 of FIG. 3. Additionally, the figure depicts an area 90 that may be used to position, for example, an "I" component of the core 16 on top of the trace 48, as described in more detail below with respect to FIGS. 7 and 8. The single via 68 is depicted at one end 92 of the trace 48, while the second end 94 of the trace 48 may be connected to, for example, embodiments of the control circuit circuitry 20. In the depicted embodiment, the trace 48 is an approximately rectangular trace 48. In other embodiments, the trace 48 may include other shapes such as circular shapes, curved shapes, angled shapes, and so forth. Additionally, the trace 48 may be of width $W_1$ and length $L_1$ that enables the reduction or elimination of electrical creepage and that improves clearance distances. In certain embodiments, $W_1$ may be approximately between 0.05 inches and 10 inches. In these embodiments, $L_1$ may be approximately between 0.05 and 10 inches. Indeed, the transformer 12 may be manufactured so as to have a small footprint, in some embodiments, of less than 1 inch while operating at frequencies of approximately 2 MHz and above.

Figure 5:
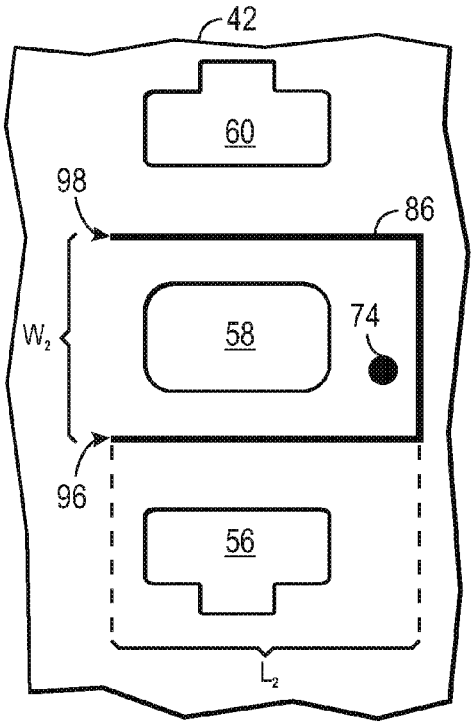
FIG. 5 is top view of an embodiment of a second layer of a printed circuit board.

FIG. 5 is a top view of an embodiment of the trace 86 (i.e., secondary coil 18) and through holes 56, 58 and 60 of the layer 42 of FIG. 3. In the depicted embodiment, the trace 86 is an approximately rectangular trace 86 having an end 96 and an end 98. The ends 96 and 98 may be suitable for interconnection with other electronic and/or electrical components of the solid state switching circuitry 22. In other embodiments, the trace 86 may have other shapes such as a circular shapes, curved shapes, triangle shapes, and so forth. In the depicted embodiment, the trace 86 is designed to be positioned approximately under the trace 48 of FIG. 4. Accordingly, in one embodiment, the trace 86 may be printed in the same layer (e.g., layer 40) as the trace 48 but on the surface opposite to the surface used to print the trace 48. In other embodiments, including the depicted embodiment, the trace 86 may be printed in a layer below the layer containing the trace 48 (e.g., layer 42). The trace 86 may have a width $W_2$ and a length $L_2$ similar to the width $W_1$ and length $L_1$ of trace 48. In certain embodiments, the width $W_2$ may be approximately between 0.05 inches and 10 inches. In these embodiments, the length $L_2$ may be approximately between 0.05 and 10 inches. As mentioned above, the trace 86 may be designed to reduce or eliminate electrical creepage and to improve clearance distances.

The depicted embodiment also illustrates a placement of the via 74 so that the via 74 is positioned approximately directly under the via 68 depicted in FIG. 4. The placement of the vias 68, 74 (and 80) allows them to be manufactured by placing all of the layers of the PCB 46 on top of one another and then using a single vertical drilling operation to create via through holes. The vias 68, 74 (and 80) may then be made electrically conductive, for example, by plating, or disposing a conductive surface or conductor (e.g., copper) in the interior of the vias. Further, the middle layer 42 does not require a via for the single-turn secondary coil 18 (e.g., trace 86). Reducing the number of vias used to manufacture the PCB 46 reducing the time and costs associated with manufacturing and inspection of the PCB 46.

Figure 6:
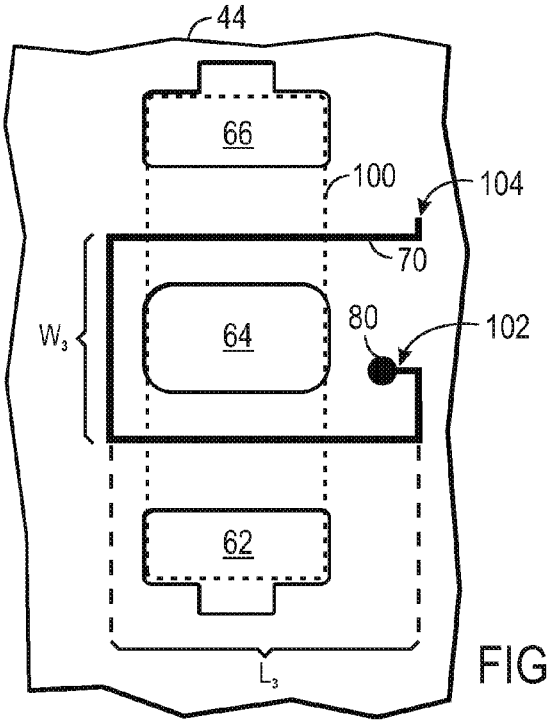
FIG. 6 is top view of an embodiment of a third layer of a printed circuit board.

FIG. 6 is a top view of embodiments of the trace 70 (i.e. second turn of the primary coil 14) and through holes 60, 62, and 64 of the layer 44 of FIG. 3. Additionally, the figure depicts an area 100 that may be used to position, for example, an "E" component of the core 16 on top of the trace 70, as described in more detail with respect to FIGS. 7 and 8 below. The single via 80 is also depicted at one end 102 of the trace 70, while the second end 104 of the trace 70 may be connected to, for example, embodiments of the control circuitry 20. In the depicted embodiment, the trace 70 is an approximately rectangular trace 70. As mentioned above, other embodiments of the traces, such as the trace 70, may include shapes such as circular shapes, curved shapes, angled shapes, and so forth. In a preferred embodiment, the trace 70 is of approximately equal dimensions to the trace 48 of FIG. 4. Accordingly, the trace 70 may have width $W_3$ approximately equal to $W_1$ and a $L_3$ approximately equal to $L_1$ of the trace 48 of FIG. 4.

In a presently contemplated embodiment, the trace 70 is formed on the lower surface 84 of the layer 44. Forming the trace 70 on the lower surface 84 may aid in connecting other components to the primary coil 14, such as electrical and/or electronic components of the control circuitry 20 residing on the lower surface 84. In other embodiments, the trace 70 may be formed on the top surface 82 of the layer 44 or on the bottom surface 78 of the layer 42. In the depicted example, the via 80 is positioned approximately directly under the via 74, which in turn is positioned directly under the via 68. Accordingly, the trace 70 may be electrically coupled to the trace 68, thus forming the two-turn primary coil 14. The design of the transformer 12, including the two-turn primary coil 14 and/or single-turn secondary coil 18, may be used to create boards 46 having any number of layers, including two layer boards, three layer boards, four layer boards, five layer boards, six layer boards, and so on, as described in more detail with respect to FIGS. 7 and 8 below. Such flexibility in layering the components of the transformer 12 enhances the design flexibility and implementation of various circuits, such as the example circuit of FIG. 11.

FIG. 7 is an exploded view depicting embodiments of an "E" core component 106, an "I" core component 108, and the assembled board 46. The core components 106 and 108 may include materials such as ferrite, carbonyl iron, soft iron, vitreous metal, and so forth. Indeed, any material suitable for directing a magnetic flux may be used. The "E" core component 106 includes three posts (e.g., "legs"), 112, 114, and 116. In a preferred embodiment, the center leg 114 may be approximately twice the width of the lateral legs 112 or 114. In this embodiment, the center leg may carry approximately twice the flux of either of the legs 112 or 114.

The legs 112, 114, and 116 may be inserted through openings of the PCB 46, such as the through holes of 50, 52, and 54 of the layer 40, through holes 56, 58, and 60 of the layer 42, and through holes 62, 64 and 66 of the layer 44. Indeed, the "E" core component 106 may be inserted through the openings of all of the layers that make up the board 46, as depicted. The "I" core component 108 may then be placed on top of the legs 112, 114, and 116 of the "E" core component 106, thus forming the core 16 of the transformer 12. In certain embodiments, a fastener such as a metal tab may then be used to mechanically fasten the components 106 and 108 to each other. In other embodiments, the two components 106 and 108 may be secured to each other with solder, conductive adhesive, and so forth. Indeed, any type of fastening device capable of securing the "E" core component 106 to the "I" core component 108 while maintaining flux conductivity between the two components 106 and 108 may be used. It is also to be understood that, in other embodiments, the core 16 may be constructed out of two "E" core components 106. That is, the "I" core component 108 may be replaced by another "E" core component 106, as depicted in FIG. 9. Indeed, other core components may include laminated core components, cylindrical rod core components, C-shaped core components, toroidal core components, and so forth.

FIG. 8 is a side view of embodiments of the "E" core component 106, a board 118, and the "I" core component 108. In the depicted embodiments, the "E" core component 106 is traversing all layers of the board 118 so as to allow the legs 112, 114, and 116 to protrude from the top of the board 118. The "I" core component 108 may then be positioned on top of the legs 112, 114, and 116 of the "E" core component 106, as depicted. The two core components 106 and 108 may then be fastened to each other using a variety of fastening techniques such as a metal tab, a solder, a conductive adhesive, and so forth. In this embodiment, the board 118 includes six layers. Indeed, boards having any number of layers, such as two, three, four, five, six, seven, eight, nine, ten layers may be used. By adding or removing layers (as shown in dashes), specific distances may be achieved between the single-turn secondary coil 18 and the turns of the primary coil 16. Such distances enable fine tuning of the clearance distances between the single-turn secondary coil 18 and the turns of the primary coil 14. Additionally, such distances enable a fine tuning of the magnetic flux properties of the transformer 12 as described below.

In the depicted embodiment, two layers 120 and 122 are disposed between the layers 40 and 42, and one layer 124 is disposed between the layers 42 and 44. Clearance distances between the primary coil 14 and the secondary coil 18 may be increased by adding more layers between the layers 40, 42, and 44. Additionally, the depth of the layers, including the depth of each of the layers 40, 42, 44, 120, 122, and 124 may be selected to meet desired clearance distances. Further, the number of layers and/or the depth of each of layers may be chosen so as to manufacture the transformer 12 with a specific magnetic field strength. For example, increasing the distances between the primary coil 14 and the secondary coil 18 reduces the magnetic field strength, while decreasing the distances between the primary 14 coil and the secondary coil 18 increases the magnetic field strength. Such fine tuning capabilities enable the transformer 12 to be used in a variety of circuitry, for example the SCR motor controller example circuitry described in more detail below with reference to FIG. 11.

FIG. 9 is an exploded view depicting embodiments of the "E" core component 106, a second "E" core component 127, and the assembled board 46. As mentioned previously, the transformer core 16 may be manufactured out of other core components, such as the two "E" core components 106 and 127. In this embodiment, the second "E" core component 127 replaces the "I" core component of FIGS. 7 and 8. In yet another embodiment depicted in FIG. 10, a "C" core component 129 and an "I" core component 131 are used. In this embodiment, a single trace primary coil 133 and a single trace secondary coil 135 may be printed or formed onto a board. In the depicted example, the single trace primary coil 133 may be printed on the bottom surface of the layer 40, and the single trace secondary coil 135 may be printed on the bottom surface of the layer 42. Such a printing or forming may enable the traces 133 and 135 to be kept away from conductive core embodiments. Indeed, a variety of traces and core components may be used to manufacture the transformer 12, as depicted.

FIG. 11 is illustrative of an embodiment of a single pole of a motor controller circuit 126 that may include embodiments of the transformer 12 as described herein. Indeed, the transformer 12 may be incorporated in a variety of circuits, including motor control circuits, power conversion circuits, photographic flash circuits, light dimming circuits, and so forth. In the illustrated embodiment, the motor controller circuit 126 may include, for example, gate drive modalities that are capable of starting a motor 128, stopping the motor 128, regulating the speed of the motor 128, regulating motor torque, protecting against overloads or faults, and so forth. The control circuitry 20 of the motor controller circuit 126 may include a metal-oxide semiconductor field effect transistor (MOSFET) driver integrated circuit (IC) 128. The MOSFET driver IC 128 may be capable of converting an input signal, such as a pulse-width modulation (PWM) input signal, into an output signal capable of driving a MOSFET transistor 130. The MOSFET transistor 130 may then be modulated by the PWM signals generated by the MOSFET driver IC 128 to switch on and off (e.g., pulse) the primary coil 14 of the transformer 12. Such generated signals may be high speed signals.

The primary coil 14 may be electrically isolated from the secondary coil 18, as mentioned above. The electrical isolation may be capable of protecting the solid state switching circuit 22 from overloads or faults in the control circuit 20, and vice versa. The modulation of the primary coil 14 may result in a varying magnetic field, which in turn may result in an equivalent modulation of the secondary coil 18. In certain embodiments, the secondary coil 18 may be connected to one or more SCRs, such as SCR 132. More specifically, the secondary coil 18 may be connected to a gate of the SCR 132, thus enabling the switching on or off of the SCR 132. The switching (i.e., modulation) of the SCR 132 thus allows for a current to flow into the motor 130 from the power supply 134 (e.g., approximately 690 volts). By fast switching of SCRs, such as the SCR 132, the circuit 136 is capable of controlling motor speed, motor torque, forward direction, reverse direction, and so forth. It is to be understood that other embodiments of the motor controller circuit 126 may include insulated-gate bipolar transistor (IGBT) drives, bipolar transistor drives, or a combination thereof.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A transformer system comprising:

a primary coil comprising a first single-turn disposed on a first board layer of a circuit board and a second single-turn disposed on a third board layer of the circuit board;

a core;

a single-turn secondary coil formed on only a single second board layer of the circuit board and;

a fourth board layer of the circuit board disposed between the first and the second board layers and having no transformer turns, wherein a first current flow through the primary coil creates a magnetic flux in the core, wherein the magnetic flux induces a second current flow in the single-turn secondary coil, wherein the circuit board comprises a fifth board layer, and a sixth board layer, wherein the fifth board layer is disposed between the fourth and the second board layers, the sixth board layer is disposed between the second and the third board layers, and wherein the fifth and sixth board layers have no transformer turns.

2. The system of claim 1, wherein the first single-turn is disposed on a top surface of the first board layer.

3. The system of claim 1, wherein the second single-turn is disposed on a bottom surface of the third board layer.

4. The system of claim 1, wherein the circuit board comprises a polytetrafluoroethylene substrate, a fire retardant (FR) substrate, a composite epoxy material (CEM) substrate, a glass (G) substrate, a national electrical manufacturers association (NEMA) substrate, or a combination thereof.

5. The system of claim 1, wherein the first single-turn is electrically coupled to the second single-turn through a first via in the first board layer, a second via in the second board layer, a third via in the third board layer, a fourth via in the fourth board layer, a fifth via in the fifth board layer, and a sixth via in the sixth board layer.

6. The system of claim 1, wherein the core comprises an "E" core element and an "I" core element.

7. The system of claim 1, comprising a primary coil circuit, wherein the primary coil circuit is configured to drive the primary coil at a frequency of at least approximately 1.5 MHz.

8. The system of claim 1, wherein the primary coil comprises only the first and the second single-turns

9. A transformer system comprising:

a primary coil formed on a first layer and a third layer of a printed circuit board;

a core;

a single-turn secondary coil formed on only a single second layer of the printed circuit board and;

a fourth board layer of the circuit board disposed between the first and the second board layers and having no transformer turns, wherein a first current flow through the primary coil creates a magnetic flux in the core, and wherein the magnetic flux induces a second current flow in the single-turn secondary coil, wherein the primary coil comprises a first single-turn disposed on the first layer and a second single-turn disposed on the third layer, wherein the circuit board comprises a fifth board layer, and a sixth board layer, wherein the fifth board layer is disposed between the fourth and the second board layers, the sixth board layer is disposed between the second and the third board layers, and wherein the fifth and sixth board layers have no transformer turns.

10. The system of claim 9, wherein the primary coil comprises a first conductive trace and wherein the single-turn secondary coil comprises a second conductive trace having substantially the same width as the first conductive trace.

11. The system of claim 9, wherein the core comprises an "E" core component and an "I" core component.

12. The system of claim 9 wherein the core comprises a "C" core component and an "I" core component.

13. A transformer system comprising:

a primary coil circuit configured to provide an input current;

a transformer having a primary coil coupled to the primary coil circuit to receive the input current, a core, and a single-turn secondary coil formed on only a single second layer of a printed circuit board;

a secondary coil circuit configured to receive output current from the single-turn secondary coil for provision of current to a load and;

a fourth board layer of the circuit board disposed between a first and the second board layers and having no transformer turns, wherein the primary coil comprises a first single-turn disposed on the first board layer of the printed circuit board and a second single-turn disposed on a third board layer of the printed circuit board, wherein the second board layer is disposed between the first and the third board layers of the printed circuit board, wherein the circuit board comprises a fifth board layer, and a sixth board layer, wherein the fifth board layer is disposed between the fourth and the second board layers, the sixth board layer is disposed between the second and the third board layers, and wherein the fifth and sixth board layers have no transformer turns.

14. The system of claim 13, wherein the load comprises an electric motor.

15. The system of claim 13, wherein the primary coil circuit comprises a gate driver circuit.

16. The system of claim 15, wherein the secondary coil circuit comprises a silicon controlled rectifier (SCR), and wherein the second current drives the SCR.

* * * * *